US011205833B2

(12) United States Patent
Wang et al.

(10) Patent No.: US 11,205,833 B2
(45) Date of Patent: Dec. 21, 2021

(54) ELECTRONIC DEVICE AND ANTENNA

(71) Applicant: Lenovo (Beijing) Co., Ltd., Beijing (CN)

(72) Inventors: Wenlei Wang, Beijing (CN); Chang Su, Beijing (CN); Weimin Bao, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 46 days.

(21) Appl. No.: 16/729,373

(22) Filed: Dec. 28, 2019

(65) Prior Publication Data

US 2020/0212535 A1 Jul. 2, 2020

(30) Foreign Application Priority Data

Dec. 29, 2018 (CN) ..... 201811646097.8

(51) Int. Cl.

| | |
|---|---|
| ***H01Q 1/36*** | (2006.01) |
| ***H01Q 1/22*** | (2006.01) |
| ***H01Q 5/314*** | (2015.01) |
| ***H01Q 9/30*** | (2006.01) |
| ***H01Q 21/30*** | (2006.01) |
| ***H01Q 13/10*** | (2006.01) |

(52) U.S. Cl.

CPC ..... *H01Q 1/2258* (2013.01); *H01Q 1/36* (2013.01); *H01Q 5/314* (2015.01); *H01Q 9/30* (2013.01); *H01Q 13/10* (2013.01); *H01Q 21/30* (2013.01)

(58) Field of Classification Search

CPC ..... H01Q 1/2258; H01Q 9/30
USPC ..... 342/702
See application file for complete search history.

(56) References Cited

U.S. PATENT DOCUMENTS 6,356,173 B1 * 3/2002 Nagata ..... H01L 23/66 257/664

FOREIGN PATENT DOCUMENTS

| | | | |
|---|---|---|---|
| CN | 103296385 | A | 9/2013 |
| CN | 105720382 | A | 6/2016 |
| CN | 106450658 | A | 2/2017 |
| CN | 108470978 | A | 8/2018 |
| WO | 2018150202 | A1 | 8/2018 |

* cited by examiner

*Primary Examiner* — Peguy Jean Pierre
(74) *Attorney, Agent, or Firm* — Anova Law Group, PLLC

(57) ABSTRACT

Embodiments of the present disclosure provide an electronic device and an antenna. The antenna for includes a first component configured for high frequency feed; a second component configured for low frequency feed; a third component configured for high frequency signal transmission; and a fourth component configured for low frequency signal transmission. The first component is coupling a high frequency signal to the third component, and the second component is coupling a low frequency signal to the fourth component.

17 Claims, 4 Drawing Sheets

ELECTRONIC DEVICE AND ANTENNA

CROSS-REFERENCES TO RELATED APPLICATION

This application claims priority to Chinese Patent Application No. 201811646097.8, entitled "Electronic Device and Antenna Thereof," filed on Dec. 29, 2018, the entire content of which is incorporated herein by reference.

FIELD OF TECHNOLOGY

The present disclosure relates to the field of antenna technology, and more specifically, to an electronic device and an antenna thereof.

BACKGROUND

Because of its attractive appearance and texture, metal casing has been a preference of users, and has gradually become the trend of notebook computer design. However, because the metal case has a shielding effect on the antenna radiation, the bandwidth of the antenna can be narrowed, deteriorating the performance of the antenna.

BRIEF SUMMARY OF THE DISCLOSURE

One objective of the present disclosure is to provide an antenna for electronic device, and to increase the antenna bandwidth and meet the antenna performance requirements. Another objective of the present disclosure is to provide an electronic device having the antenna.

On aspect of the present disclosure provides an antenna for an electronic device. The antenna includes a first component configured for high frequency feed; a second component configured for low frequency feed; a third component configured for high frequency signal transmission; and a fourth component configured for low frequency signal transmission. The first component is coupling the high frequency signal to the third component, and the second component is coupling the low frequency signal to the fourth component.

In the present disclosure, the first and third components together form a high frequency component, which has an independent high frequency bandwidth. The second and fourth components together form a low frequency component, which has an independent low frequency bandwidth. A superposition of the two frequency bands may be the antenna bandwidth covering the entire frequency band.

In addition, in the present disclosure, the antenna performance does not require an antenna switch or an antenna tuner. The antenna structure is simple, its cost is low, and the calibration/debugging process is convenient to carry out.

The present disclosure also provides a method of manufacturing the antenna consistent with the present disclosure. The antenna including a first component, a second component, a third component, and fourth component. The method of manufacturing the antenna. The method of manufacturing the antenna includes coupling the first component with the third component. The first component is configured to feed a high frequency signal to the third component. The method includes coupling the second component with the fourth component. The second component is configured to feed a low frequency signal to the fourth component.

BRIEF DESCRIPTION OF THE DRAWINGS

For a more complete understanding of the present disclosure, and the advantages thereof, reference is now made to the following descriptions to be taken in conjunction with the accompanying drawings. The accompanying drawings in the following description show merely some embodiments of the present invention, and a person of ordinary skill in the art may still derive other drawings from these accompanying drawings without creative efforts.

DETAILED DESCRIPTION

The embodiment of the present disclosure provides an antenna for electronic device, which is able to increase the antenna bandwidth, and also meets antenna performance requirements.

In order to more clearly present the objectives, technical solution and advantage of the embodiments, the following content is a detailed and complete description of the embodiments and technical solution included in the present application, referring to the attached figures of the present application. Obviously, the embodiments described in the following content are only a part of this application, not all of them. Based on the illustrated embodiments in the application, for those of ordinary skill in the art, all other embodiments which can be obtained without creative labor, shall be in the protection scope of this application.

Figure 1:
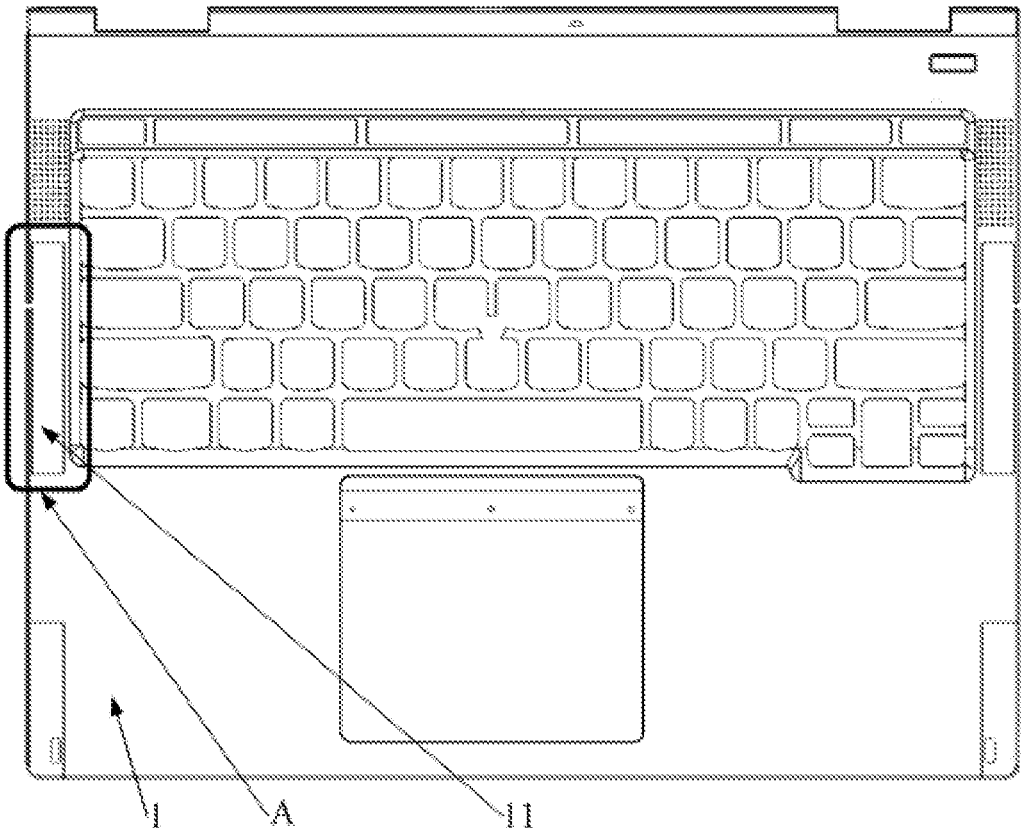
FIG. 1 is a schematic diagram of the antenna consistent with embodiments of the present disclosure.
Figure 2:
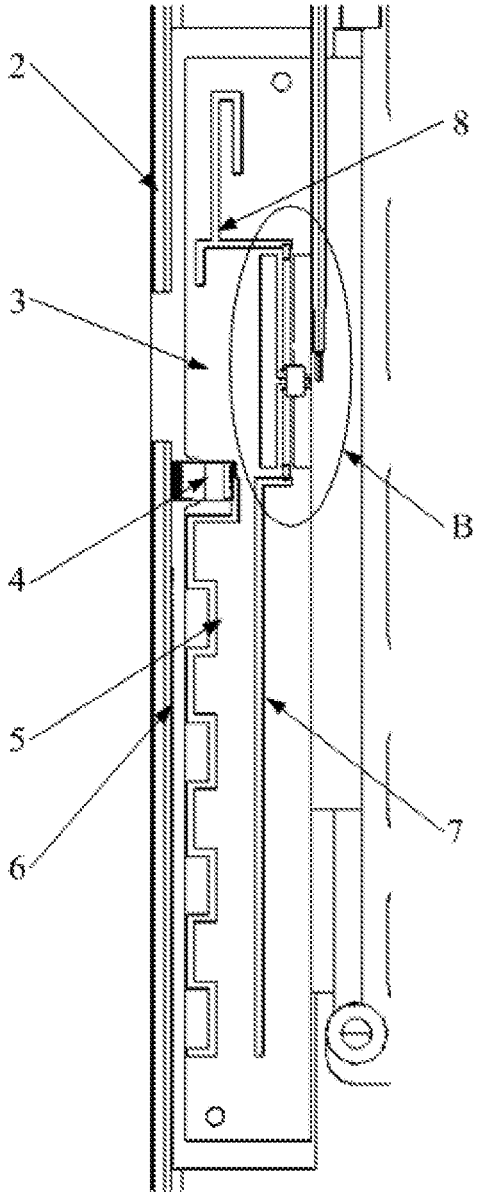
FIG. 2 is an enlarged view of Part A illustrated in FIG. 1.
Figure 3:
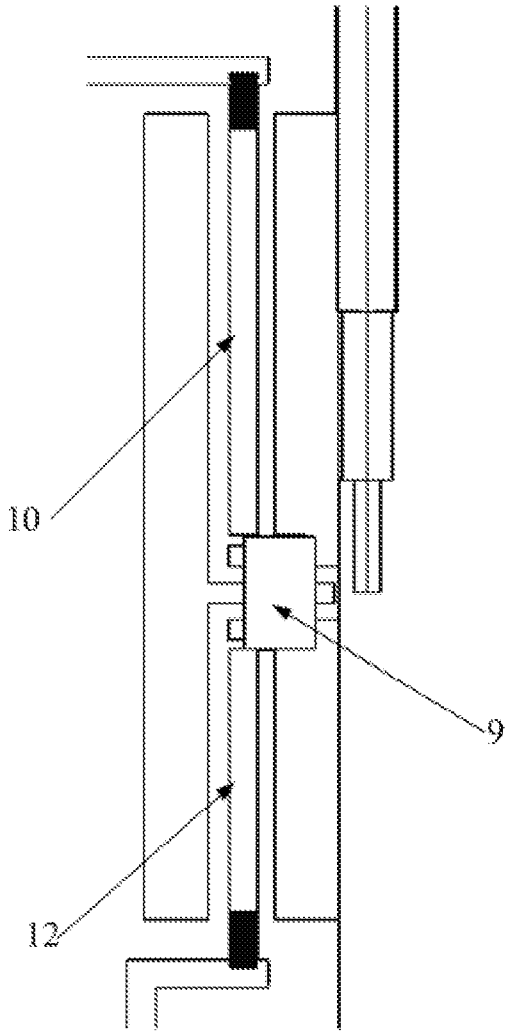
FIG. 3 is an enlarged view of Part B illustrated in FIG. 1.

As shown in FIGS. 1-3, an embodiment of the present disclosure provides an electronic device, which includes a first component, a second component, a third component, and a fourth component. The first component is used for high frequency feed; the second component is use for low frequency feed; the third component is used for high frequency signal transmission; and the fourth component is used for low frequency signal transmission. The first component couples high frequency signals to the third component. The second component couples low frequency signals to the fourth component.

In the present disclosure, the first and third components work coordinately to form a high frequency component, which has an independent high frequency bandwidth. The second and fourth components work coordinately to form a low frequency component, which has an independent low frequency bandwidth. A superposition of the two bandwidths may be the antenna bandwidth, which is capable to cover the entire frequency band, Therefore, embodiments of the present disclosure increase the antenna bandwidth, and meet the antenna performance requirements.

In addition, in embodiments of the present disclosure, the antenna does not require an antenna switch or an antenna tuner, and its structure is simple, its cost is low, and the calibration/debugging process is convenient to carry out.

In some embodiments, the first component is not electronically connected to the third component, and the second component is not electronically connected to fourth component. As an example, in this embodiment, the first component is coupled to the third component, and the second component is coupled to the fourth component, through wireless resonant coupling signals. This is convenient for deployment and installation of the antenna. In other embodiments, the aforementioned first component can be electronically connected to the third component, and the second component can be electronically connected to the fourth component as well, through wired coupling signal.

As shown in FIG. 1, the antenna is installed inside an electronic device, and the electronic device includes a metal case 1 with an open groove 11. More specifically, this electronic device may be a laptop computer, and the metal case 1 can also be the screen, or the metal case 1 may be a case of a dock of the laptop. To increase the installation space, the open groove 11 may be a U-shaped groove, or can have a different shape, such as C-shaped and trapezoidal, etc.

As shown in FIGS. 2-3, in this embodiment, a first metal frame 2 connected to the wall of one end of the open groove 11 forms the aforementioned third component; a second metal frame 6 connected to the wall of the other end of the open groove 1 forms the aforementioned fourth component. There is a gap between the second metal frame 6 and the first metal frame 2. A support plate is located in the open groove 11. The support plate is configured with a first antenna pattern 8 coupled with the first metal frame 2 to generate high frequency resonance. A second antenna pattern 7 is coupled with the second metal frame 6 to generate low frequency resonance. The first antenna pattern 8 forms the first component, and the second antenna pattern 7 forms the second component. The duplexer 9 consisting of antenna port. The duplexer 9 may connect to the RF module. The duplexer 9 and the first antenna pattern 8 may connect and form a high frequency feed point. The connection of the second antenna pattern 7 and the duplexer 9 may form a low frequency feed point.

The first metal frame 2 and the second metal frame 6 surround the opening of the open groove 11, and are connected to the metal case 1. The gap between the first metal frame 2 and the second metal frame 6 is used for signal passing through, for transmitting and receiving signals. In order to facilitate efficient manufacturing processes, the metal case 1 can be integrated with the first metal frame 2 and the second metal frame 6. In some embodiments, these can also be separate structures and connected by soldering.

In this embodiment, the high frequency feed point of the antenna is connected to the first antenna pattern 2 on the support plate. The high frequency transmission signal is coupled to the first metal frame 2 connected to the metal case 1 through the first antenna pattern 8 on the support plate. The low frequency feed point of the antenna is connected to the second antenna pattern 7 on the support plate. The low frequency transmission signal is coupled to the second metal frame 6 connected to the metal case 1 through the second antenna pattern 7 on the support plate.

The first metal frame 2 and the first antenna pattern 8 coordinate and form the high frequency component. The second metal frame 6 and the second antenna pattern 7 coordinate and form the low frequency component. The feed points of first antenna pattern 8 and the second antenna pattern 7 are connected through the duplexer 9. In some embodiments, the first component and the third component are integrated on the support plate, and the second component and fourth component are integrated on the metal frames, which simplifies the antenna structure, and is convenient to assemble, and saves the component space.

Understandably, the first component and the third component can be independent wires as well, moreover, the second component and the third component can be independent wire or metal plate and so on. The present disclosure does not exhaust all configurations.

Specifically, the antenna of this embodiment may be an LTE antenna. Its signal may be coupled to a metal frame connected to the metal case 1, so that the antenna is able to cover the entire LTE frequency band, and meets the performance requirements of the LTE antenna.

Figure 4:
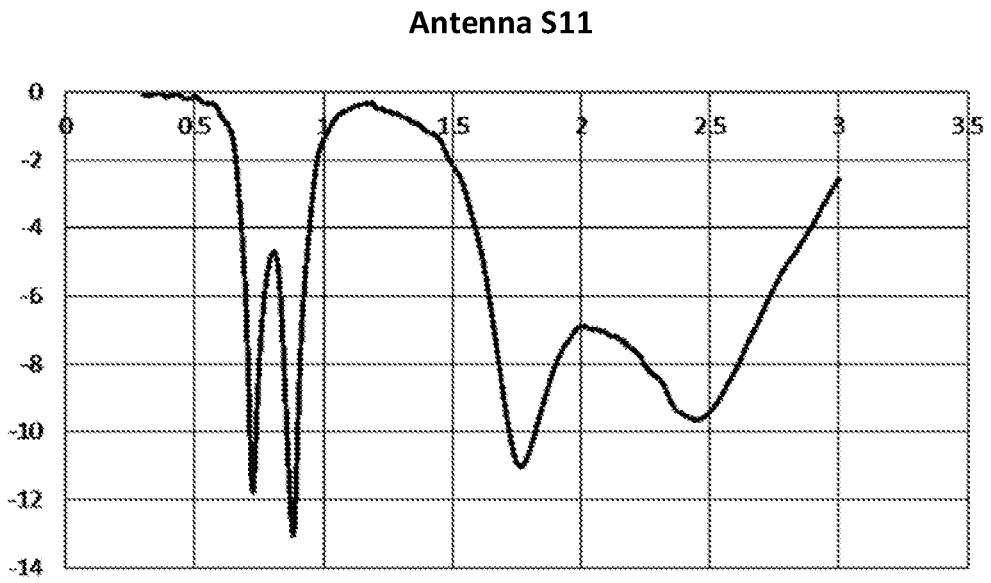
FIG. 4 is a diagram of a broadened bandwidth, formed by S11, with the low frequency portion and the high frequency portion of the antenna coupled through a series inductance, consistent with embodiments of the present disclosure.

In one embodiment, the first antenna pattern 8 and the second antenna pattern 7 are connected to the duplexer 9 in series. Accordingly, the low frequency component and high frequency component of the antenna shall be matched with series inductances respectively. As shown in FIG. 3, the antenna S11 forms 2 W-shapes, so that the bandwidth can be expanded. As shown in FIG. 4, after the high frequency component and the low frequency component being matched by series inductances, the two components are isolated, and perform independently. They can be directly inter-connected through the duplexer 9 after calibration/debugging respectively and being combined as one antenna port. Understandably, the first antenna pattern 8 and the second antenna pattern 7 can also be connected in parallel with the duplexer 9.

In some embodiments, the first antenna pattern 8 is connected in series with the duplexer 9 through a first connection wire 10. The second antenna pattern 7 is connected in series with the duplexer 9 through a second connection wire 12. As shown in FIG. 3, in this embodiment, the first antenna pattern 8 and the second antenna pattern 7 are connected in series with the duplexer 9 through wires, which is conveniently designed for installation.

In order to reduce the space being occupied, the second connection wire 12 may be coaxial with the first connection wire 10, and parallel to the first metal frame 2. In some embodiments, the second connection wire 12 and the first connection wire 10 may be non-coaxial and may also be bended, or may form an angle to the first metal frame 2. Alternatively, the present disclosure may also realize the series connection of the first antenna pattern 8 and the second antenna pattern 7 with the duplexer 9 through antenna patterns.

As shown in FIGS. 1-3, the first antenna pattern 8 includes a first L-shaped line. The first L-shaped line includes a short longitudinal line segment parallel to the first metal frame 2, and a long horizontal line segment vertical to the first metal frame 2. The long horizontal line segment is connected to the first connection wire 10. The first antenna pattern 8 also includes a U-shaped line. The U-shaped line includes a middle connecting segment vertical to the first metal frame 2, a first longitudinal segment and a second longitudinal segment parallel to the first metal frame 2. The first longitudinal segment is close to the first metal frame 2 and is connected to the long horizontal line segment. In the present disclosure, the first antenna pattern 8 is formed by a combination of the first L-shaped line and the U-shaped line, which is a simple structure. Moreover, the first antenna pattern 8 can also be other patterns, which are not be specifically limited herein.

The second antenna pattern 7 includes a second L-shaped line. The second L-shaped line includes, a long longitudinal line segment parallel to the second metal frame 6, and a short horizontal line segment vertical to the second metal frame 6. The short horizontal line segment is connected to the second connection wire 12. In the present disclosure, the second antenna pattern 7 is formed by the second L-shaped line, which is a simple structure. Moreover, the second antenna pattern 7 can also be other patterns, which are not be specifically limited herein.

In order to further optimize the above technical solution, a third antenna pattern 5 may be further provided on the support plate. The third antenna pattern 5 may be connected to the second metal frame 6 to form the fourth component. The present embodiment extends the length of the fourth part by the third antenna pattern 5, adjusting antenna resonance frequency. Therefore, the length of the second metal frame 6 is shortened. The space occupied by the antenna is reduced. The size of the open groove of the metal casing is further reduced.

The third antenna pattern 5 may also be replaced by a wire, a metal plate, and so on. In some embodiments consistent with the present disclosure, an embodiment may not include the third antenna pattern 5, and the entire fourth component can be formed by the second metal frame 6 itself.

In some embodiments, the third antenna pattern 5 and one end of the second metal frame 6, which is near the first metal frame 2, are connected by a conductive clip 4. Accordingly, the end of the second metal frame 6 is connected to the third antenna pattern 5 through the conductive clip 4. The conductive clip 4 can replace part of the second metal frame 6 to reduce the length of the second metal frame 6 further. The overall size of the antenna may thus be smaller than other metal frame antennas, occupying less space in an electronic device. Alternatively, the third antenna pattern 5 and the second metal frame 6 may also be connected by a wire or by direct soldering.

In order to have the maximum length in a smallest area, so that the open groove on the metal case 1 can be as small as possible, the third antenna pattern 5 shall be a serpentine line, which includes a plurality of longitudinal line segments parallel to the second metal frame, and a plurality of horizontal line segments vertical to the second metal frame 6. The conductive clip 4 may be vertical to the second metal frame 6.

In some embodiments, the aforementioned third antenna pattern 5 can also have other different shapes, such as wave shapes or irregular zigzag shapes, and so on.

In some embodiments, the support plate may be a PCB 3. The first antenna pattern 8, the second antenna pattern 7, and the third antenna pattern 5 may all be printed on the PCB 3. In one embodiment, the patterns on the PCB 3 is a part of the antenna, which is convenient to fibrate. Obviously, the aforementioned support plate can also be a separate plastic board, and so on.

Figure 5:
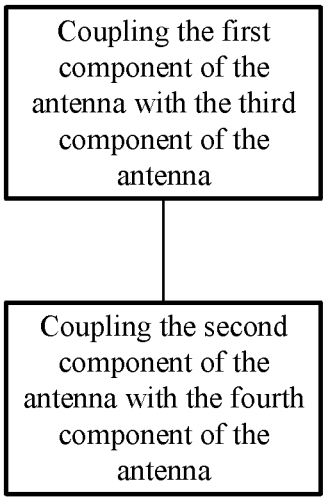
FIG. 5 is a flow chart for a method of manufacturing the antenna consistent with embodiments of the present disclosure.

FIG. 5 further illustrates a method of manufacturing the antenna consistent with the present disclosure. As described in FIG. 5, the antenna including a first component, a second component, a third component, and fourth component. The method of manufacturing the antenna includes coupling the first component with the third component. The first component is configured to feed a high frequency signal to the third component. The method includes coupling the second component with the fourth component. The second component is configured to feed a low frequency signal to the fourth component. Further, the method includes coupling the first component wirelessly with the third component; and coupling the second component wirelessly with the fourth configured.

The antenna may be installed inside an electronic device, which may include a metal case. The method of manufacturing may further include providing a first metal frame as a part of the third component; providing a second metal frame as a part of the fourth component. A gap exists between the second frame and the first metal frame. Further, the method includes providing a support plate located inside the open groove. The support plate is configured with a first antenna pattern coupled with the first metal frame to generate a high frequency resonance, and configured with a second antenna pattern coupled with the second metal frame to generate a low frequency resonance. The first antenna pattern is included in the first component, and the second antenna pattern is included second component; and providing a duplexer consisting of an antenna port, configured to connect to an RF module. A high frequency feed point is formed by the first antenna pattern and the duplexer, and a low frequency feed point is formed by the second antenna pattern and the duplexer.

The method of manufacturing may further include connecting the first antenna pattern and the second antenna pattern to the duplexer in series, connecting the first antenna pattern to the duplexer in series, through a first connecting wire; and connecting the second antenna pattern to the duplexer in series, through a second connecting wire, the second connecting wire being coaxial to the first connecting wire, and parallel to the first metal frame. The support plate may be configured with a third antenna pattern. The method of manufacturing may further include connecting the third antenna pattern to the second metal frame to form the fourth component, and connecting the third antenna pattern to an end of the second metal frame close to the first metal frame by a conductive clip.

In some embodiments, the third antenna pattern is a serpentine line, including a plurality of longitudinal line segments parallel to the second metal frame, and a plurality of horizontal line segments are vertical to the second metal frame; and the conductive clip is vertical to the second metal frame.

In some embodiments, the support plate being a PCB. The method of manufacturing may further include printing the first antenna pattern, the second antenna pattern, and the third antenna pattern on the PCB.

In embodiments consistent with this disclosure, the antenna can independently calibrate or debug it high and low frequency resonances, thereby achieving great antenna performance. The design of the antenna has a small antenna size.

This disclosure also provides an electronic device, which includes a case and an antenna, wherein the antenna can be any one of the antennas provided in the aforementioned embodiments. The antenna is consistent with the present disclosure, and can achieve an increased bandwidth and meet the requirements of antenna performance. The advantages in such electronica devices are achieved by the antenna design, which are described in the relevant parts in the foregoing embodiments for details, and will not be repeated herein again.

The electronic device in this embodiment may be a laptop computer, a mobile phone, a tablet computer, or any other devices requiring installing an antenna.

The embodiments in this specification are described in a progressive manner and each embodiment illustrates different aspects from other embodiments. For the same or similar parts among the embodiments, the descriptions can reference each other.

The foregoing descriptions are merely specific implementation manners of the present application, but are not intended to limit the protection scope of the present disclosure. Any variation or replacement readily derived by a person skilled in the art within the technical scope disclosed in the present disclosure shall fall within the protection scope of the present disclosure. Therefore, the present application shall not be limited to the embodiments shown herein, but should conform to the widest scope consistent with the principles and the novelties disclosed herein.

What is claimed is:

1. An antenna for an electronic device, including:

a first component configured for high frequency feed;

a second component configured for low frequency feed;

a third component configured for high frequency signal transmission; and a fourth component configured for low frequency signal transmission, wherein the first component is coupling a high frequency signal to the third component, and the second component is coupling a low frequency signal to the fourth component, wherein the antenna is installed inside the electronic device with a metal case, and the antenna comprises:

a first metal frame, connected to a wall of one end of an open groove corresponding to the metal case, forming the third component;

a second metal frame, connected to a wall of an opposing end of the open groove, forming at least a part of the fourth component, wherein a gap exists between the second metal frame and the first metal frame;

a support plate located inside the open groove, wherein the support plate is configured with a first antenna pattern coupled with the first metal frame to generate a high frequency resonance, and configured with a second antenna pattern coupled with the second metal frame to generate a low frequency resonance, the first antenna pattern is included in the first component, and the second antenna pattern is included in the second component; and a duplexer consisting of an antenna port, configured to connect to an RF module, wherein a high frequency feed point is formed by the first antenna pattern and the duplexer, and a low frequency feed point is formed by the second antenna pattern and the duplexer.

2. The antenna according to claim 1, wherein the first component is not electronically connected to the third component, and the second component is not electronically connected to fourth component.

3. The antenna according to claim 2, wherein the first component is wirelessly coupled to the third component, and the second component is wirelessly coupled to fourth component.

4. The antenna according to claim 1, wherein the first antenna pattern and the second antenna pattern are connected to the duplexer in series.

5. The antenna according to claim 4, wherein the first antenna pattern is connected to the duplexer in series, through a first connecting wire; and the second antenna pattern is connected to the duplexer in series, through a second connecting wire, the second connecting wire being coaxial to the first connecting wire, and parallel to the first metal frame.

6. The antenna according to claim 1, wherein the support plate is configured with a third antenna pattern, and the third antenna pattern is connected to the second metal frame, forming the fourth component.

7. The antenna according to claim 6, wherein the third antenna pattern connects to an end of the second metal frame close to the first metal frame by a conductive clip.

8. The antenna according to claim 7, wherein the third antenna pattern is a serpentine line, including a plurality of longitudinal line segments parallel to the second metal frame, and a plurality of horizontal line segments vertical to the second metal frame; and the conductive clip is vertical to the second metal frame.

9. The antenna according to claim 6, wherein the support plate is a PCB, and the first antenna pattern, the second antenna pattern, and the third antenna pattern are printed on the PCB.

10. A method for manufacturing an antenna including a first component, a second component, a third component, and fourth component, the antenna being installed inside an electronic device with a metal case, the method comprising:

coupling the first component with the third component, wherein the first component is configured to feed a high frequency signal to the third component;

coupling the second component with the fourth component, wherein the second component is configured to feed a low frequency signal to the fourth component;

providing a first metal frame as a part of the third component, the first metal frame being connected to a wall of one end of an open groove corresponding to the metal case;

providing a second metal frame as a part of the fourth component, the second metal frame being connected to a wall of an opposing end of the open groove, wherein a gap exists between the second frame and the first metal frame;

providing a support plate located inside the open groove, wherein the support plate is configured with a first antenna pattern coupled with the first metal frame to generate a high frequency resonance, and configured with a second antenna pattern coupled with the second metal frame to generate a low frequency resonance, the first antenna pattern is included in the first component, and the second antenna pattern is included second component; and providing a duplexer consisting of an antenna port, configured to connect to an RF module, wherein a high frequency feed point is formed by the first antenna pattern and the duplexer, and a low frequency feed point is formed by the second antenna pattern and the duplexer.

11. The method according to claim 10, further comprising:

coupling the first component wirelessly with the third component; and coupling the second component wirelessly with the fourth configured.

12. The method according to claim 10, the method further comprising:

connecting the first antenna pattern and the second antenna pattern to the duplexer in series.

13. The method according to claim 12, the method further comprising:

connecting the first antenna pattern to the duplexer in series, through a first connecting wire; and connecting the second antenna pattern to the duplexer in series, through a second connecting wire, the second connecting wire being coaxial to the first connecting wire, and parallel to the first metal frame.

14. The method according to claim 10, the support plate being configured with a third antenna pattern, the method further comprising:

connecting the third antenna pattern to the second metal frame to form the fourth component.

15. The method according to claim 14, the method further comprising:

connecting the third antenna pattern to an end of the second metal frame close to the first metal frame by a conductive clip.

16. The method according to claim 15, wherein the third antenna pattern is a serpentine line, including a plurality of longitudinal line segments parallel to the second metal frame, and a plurality of horizontal line segments are vertical to the second metal frame; and the conductive clip is vertical to the second metal frame.

17. The method according to claim 14, the support plate being a PCB, the method further comprising:

printing the first antenna pattern, the second antenna pattern, and the third antenna pattern on the PCB.

* * * * *